US006607413B2

(12) United States Patent
Stevenson et al.

(10) Patent No.: US 6,607,413 B2
(45) Date of Patent: Aug. 19, 2003

(54) METHOD FOR MANUFACTURING AN ELECTROLUMINESCENT LAMP

(75) Inventors: William C. Stevenson, Santa Ana, CA (US); Philip Chan, Santa Ana, CA (US); James Lau, Santa Ana, CA (US)

(73) Assignee: Novatech Electro-Luminescent, Inc., Chino, CA (US)

( * ) Notice: Subject to any disclaimer, the term of this patent is extended or adjusted under 35 U.S.C. 154(b) by 194 days.

(21) Appl. No.: 09/894,239

(22) Filed: Jun. 29, 2001

(65) Prior Publication Data

US 2003/0003837 A1 Jan. 2, 2003

(51) Int. Cl.[7] ..... H05B 33/10

(52) U.S. Cl. ..... 445/24; 156/67; 427/66; 313/506

(58) Field of Search ..... 445/24; 156/67; 427/66; 313/506

(56) References Cited

U.S. PATENT DOCUMENTS 4,020,389 A * 4/1977 Dickson et al. ..... 315/246
4,534,743 A * 8/1985 D'Onofrio et al. ..... 445/24
5,184,969 A * 2/1993 Sharpless et al. ..... 445/24
5,469,019 A * 11/1995 Mori ..... 313/509
5,586,879 A * 12/1996 Szpak ..... 445/24
5,620,348 A * 4/1997 Santana et al. ..... 445/24
5,660,573 A * 8/1997 Butt ..... 445/24
5,667,417 A * 9/1997 Stevenson ..... 445/24
6,203,391 B1 * 3/2001 Murasko ..... 445/24
6,515,416 B1 * 2/2003 Chico ..... 313/506

* cited by examiner

*Primary Examiner*—Dean A. Reichard
*Assistant Examiner*—Adolfo Nino
(74) *Attorney, Agent, or Firm*—Charles C. H. Wu; Wu & Cheung, LLP

(57) ABSTRACT

A method for manufacturing low cost electroluminescent (EL) lamps is disclosed. The method of the present invention includes the first step of die cutting, embossing or chemically etching the metal foil surface of a metal foil bonded flexible electrical insulation to simultaneously form one or more rear capacitive electrodes, electrical terminations, optical registration fiducial indicia, and a continuous carrier means that is then coupled to a precisely positioned indexing system. Next, the rear metal foil capacitive electrodes are coated with a capacitive dielectric layer precisely isolating the rear electrode form. In the third step, a layer of electroluminescent phosphor ink is applied to the rear capacitive electrodes to precisely form areas of illumination. In step four, a layer of light transmissive and electrically conductive ink is applied to cover the EL phosphor layer. Next, in step five a transparent polyester film or ultraviolet activated dielectric coating is applied to the entire surface of the lamp.

65 Claims, 11 Drawing Sheets

METHOD FOR MANUFACTURING AN ELECTROLUMINESCENT LAMP

BACKGROUND OF THE INVENTION

1. Field of the Invention

The present field of the invention relates to electroluminescent lamps, and more particularly to a method for manufacturing water resistant electroluminescent lamps that are suitable for many low-cost consumer applications.

2. Description of the Prior Art

Conventional electroluminescent (EL) lamp manufacturing techniques may be divided into two basic processes. The first, a screen-printing process in which a lamp is constructed layer by layer. More particularly, the lamp is constructed using the steps of making indium tin oxide (ITO) plated plastic film; applying EL phosphor ink on the ITO plating to form lighted areas; applying capacitive dielectric ink over the EL phosphor ink; applying electrically conductive ink over the capacitive dielectric ink to form a second capacitive plate; applying electrically conductive ink over the ITO plated plastic film outboard of the capacitive dielectric ink layer to provide a front capacitive electrode connection. This first construction must then be protected from environmental attack via the means of either an encapsulating lamination, or secondarily by application of a water repellant electrical insulating coating containing an ultraviolet light activated polymer.

The screen-printing process allows intricate graphics effects to be created using relatively simple manufacturing processes. However, screen-printed EL lamps having high luminance or superior electrical characteristics tend to be costly to manufacture. This is in part due to the difficulty of precisely aligning all conductive, insulating and light emissive layers when processing is performed with typical screen-printing methods. Such layer-to-layer alignment difficulties can result in decreased production yields, especially in applications where there is limited space to provide electrical clearance between the rear electrode and front electrode connection described above.

The second common process is a laminated EL lamp assembly. In this process, a first film, which supports a metal foil, is passed below a metering roller or blade that applies an insulating layer of capacitive dielectric ink. A second, light transmissive ITO plated film is similarly passed below a roller or blade, which applies a layer of EL phosphor ink onto the ITO plating. In order to achieve both a uniform light output and reliable electrical characteristics, the thickness of the insulating dielectric and phosphor layers must be precisely controlled, along with the grain dispersion of the EL phosphor particles within the phosphor layer. Thus this typically continuous lamination requires very tight control over both ink rheology and ink application processes.

Once the ink layers have dried and been inspected for defective areas, the first and second films are laminated together to form an EL lamp core. This film lamination method requires heat and/or pressure, which must be tightly controlled so that the light and electrical characteristics of the finished lamp are consistent. Additionally, since the EL phosphor layer is sensitive to water contamination, once the finished lamp is cut into usable shape and size, then electrically terminated, it is then encapsulated within a moisture resistant lamination film (such as Allied Signal's "ACLAR" CTFE).

The continuous lamination method produces foil EL lamps, which are high performance, high priced lamps typically unsuitable for complex graphics or other price sensitive applications. Laminated foil EL lamps are also typically thicker and less flexible than screen printed lamps, limiting their application to those where flexibility and thickness are of less concern.

In both of the above methods, metal and metal oxides are plated upon a plastic carrier film that is typically used as the basis material for the front conductive layer. The usual film of choice is polyester plastic film plated with indium tin oxide (ITO). This particular plating exhibits the additional construction weakness of fracturing under close bend radius flexing. These fractures have been demonstrated to cause both dimmed areas, and even total non-illumination of EL lamps of these constructions, due to the interrupted current path at the location of breakage.

In U.S. Pat. No. 5,667,417, of which, this is an improvement of William Stevenson (one of the inventors here) teaches a method of producing low cost metal foil based EL lamps of potentially complex graphic pattern by using a precise indexing system that applies well known flexible circuit technology to a cost-effective continuous production process. In this patent, a plurality of sprocket holes allows a precise indexing and positioning of the EL lamp pattern relative to the screen-print ink applicator. This method ensures that minimal electrical clearances may be maintained, due in full to the precision preparation of metal foil electrodes relative to the indexing sprocket holes.

A weakness of this method is that the sprocket holes may show wear during multiple print layer passes by the effect of drive pressures applied to the indexing holes' leading edges during transport advance. This wear factor can contribute to print misalignment of subsequent layers, and the resulting decrease in production yield. Additionally, the space consumed by sprocket holes reduces the usable area of raw material film, and thus further limits total production yield. A further weakness shown by this process is that presently available light transmissive, electrically conductive coatings and inks have limited utility due to their inherent high resistance, when compared to traditional conductive metal and metal oxide plating over plastic film.

Accordingly, there is a need for an improved indexing means that results in increased EL lamp production accuracy and product performance versus material yield.

SUMMARY OF THE INVENTION

The present invention is directed to a method of manufacturing EL lamps incorporating some of the processes used in the manufacture of flexible printed circuit boards.

In an exemplary embodiment of the invention, the method of the present invention includes the following steps. In the first step, a process basis carrier film having metal foil bonded to its surface is prepared for further process by die cutting or chemically etching the desired rear capacitive electrodes that precisely define illuminated areas, power input distribution elements and associated electrical contacts, and optical registration indicia. Following this, the carrier film is placed onto a commercially available transport system that incorporates an optical registration system to precisely position the image area for each print cycle. This method allows the precise (+/−<0.002" in X, Y and θ axis) physical positioning of the basis carrier film without deleterious effect upon the positioning reference means. Using this method allows practically unlimited numbers of print layers to be applied without concern for layer-to-layer alignment.

In the third step, a layer of hygrophobically compounded capacitive dielectric ink is screen-printed in a pattern that completely overlaps the rear capacitive electrode foil. Through precise, optically registered positioning the capacitive dielectric ink is allowed minimal bleed past the rear electrode edges.

The fourth step consists of printing a high dielectric, hygrophobically compounded EL phosphor ink to further define the illuminated area. Again, precise optically registered positioning of the basis carrier film allows limited ink bleed beyond the rear electrode element. Following this, in the fifth step a layer of hygrophobically compounded electrically conductive, light transmissive ink is applied to cover the EL phosphor layer, forming a front capacitive electrode. The front electrode layer ink is allowed to bleed beyond the EL phosphor layer in order to make contact with a metal foil power conductor.

Next, in step six a transparent polyester film or ultraviolet activated dielectric coating is applied to the entire surface of the lamp. Openings in this layer may be made allowing exposure of the metal foil layer precisely defining electrical power contact areas. Following this step, the completed EL lamp is then cut from the basis carrier film.

A first embodiment of an EL lamp manufactured by the method of the present invention comprises a rear capacitive electrode that precisely defines the area of illumination that is bonded to either a plastic or paper core stock. A layer of capacitive dielectric is applied over the rear capacitive electrode, providing electrical isolation between the rear capacitive electrode and the overlying next printed layer of EL phosphor ink. Further a layer of translucent conductive ink is applied over the EL phosphor ink layer creating a capacitive front electrode that is protected by an insulating transparent polyester film layer.

In a second embodiment of the an EL lamp manufactured by the method of the proposed invention, the capacitive electrodes, capacitive dielectric and EL phosphor ink layers are bonded to both surfaces of the of the plastic or paper core stock. This embodiment provides a low-cost high quality and performance EL lamp that emits light from both surfaces.

The method of the present invention provides the ability to manufacture EL lamps at a cost fractional of that of comparable conventional construction. Additionally, these lower-cost EL lamps can be manufactured on readily obtainable automated production equipment.

Further features and advantages of the present invention will be appreciated by a review of the following detailed description when taken in conjunction with the following drawings.

BRIEF DESCRIPTION OF THE DRAWINGS

The present invention may be best understood by referring to the following detailed description of the preferred embodiments and the accompanying drawings, wherein like numerals denote like elements and in which.

DETAILED DESCRIPTION OF THE PREFERRED EMBODIMENTS

The following discussion focuses upon the manufacture of a lower-cost electroluminescent (EL) lamp. The lamp produced by the method of the present invention is suitable for a variety of graphics and other lighting applications.

Figure 1:
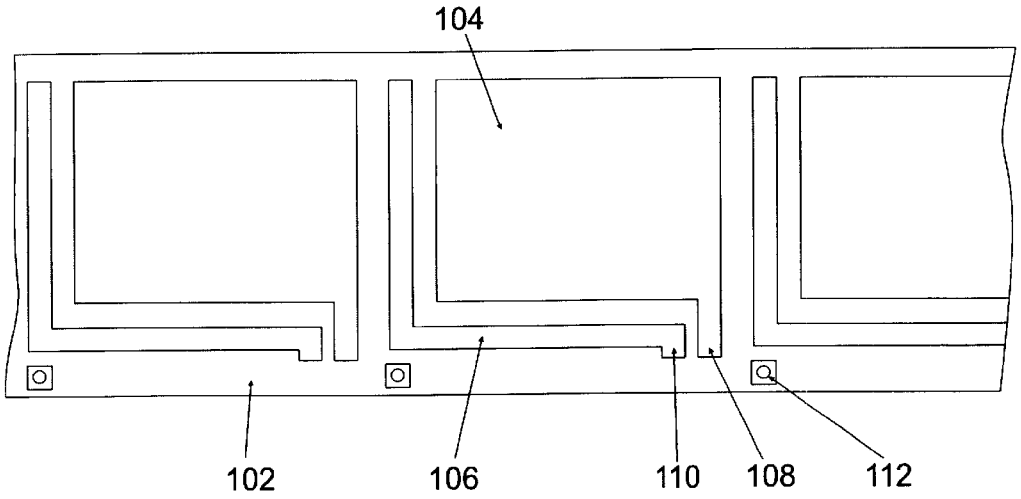
FIGS. 1(*a*)–(*e*) are a sequence of top view diagrams illustrating a method for manufacturing a low-cost EL lamp in accordance with the present invention.
Figure 1:
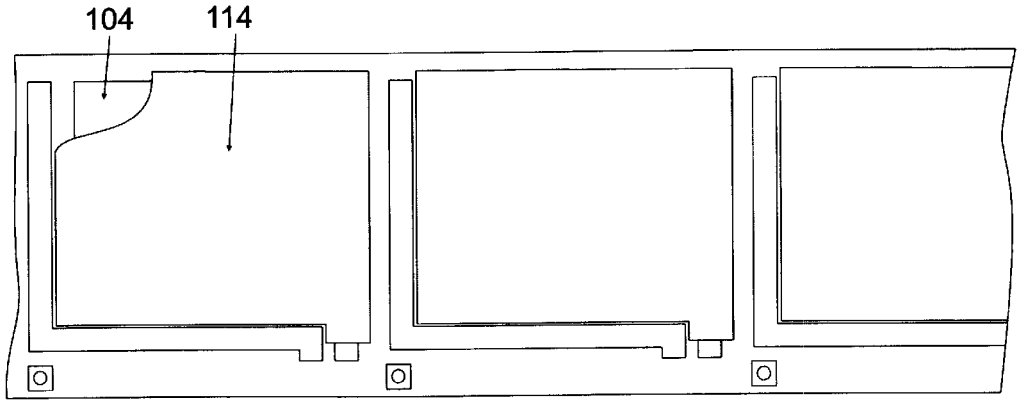
Figure 1:
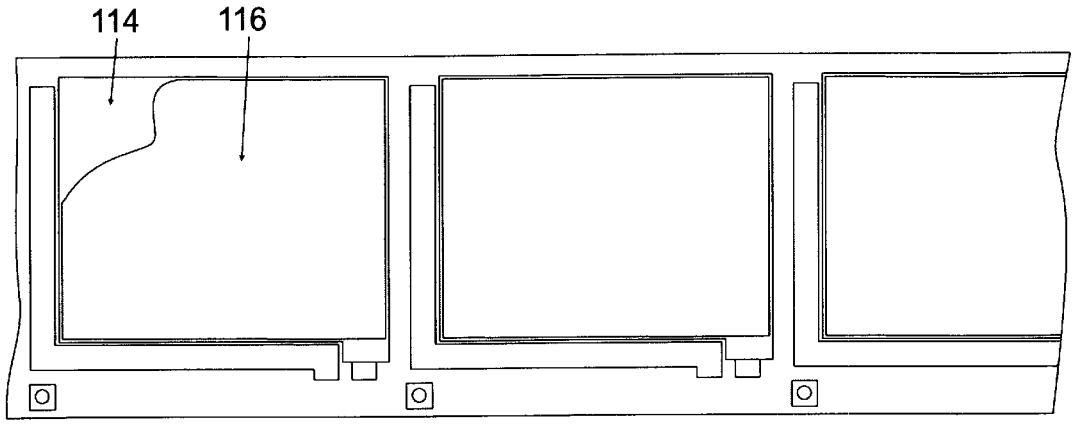
Figure 1:
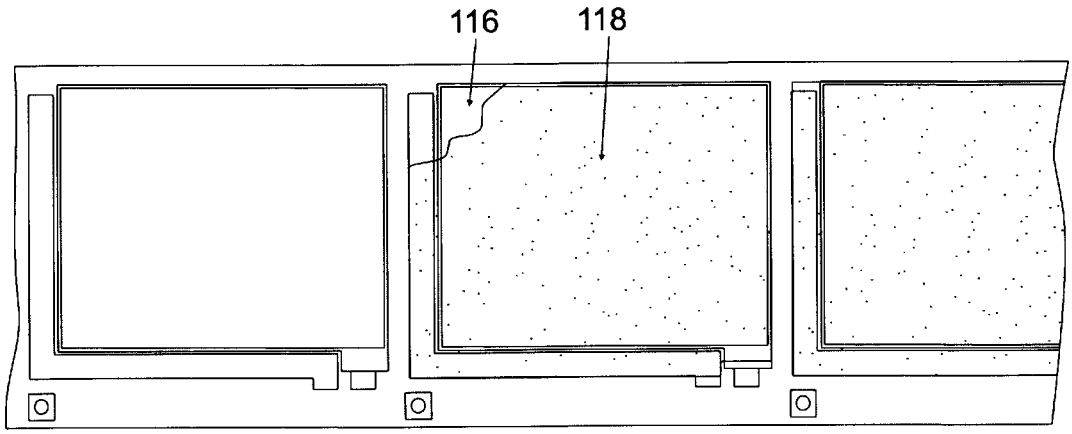
Figure 1:
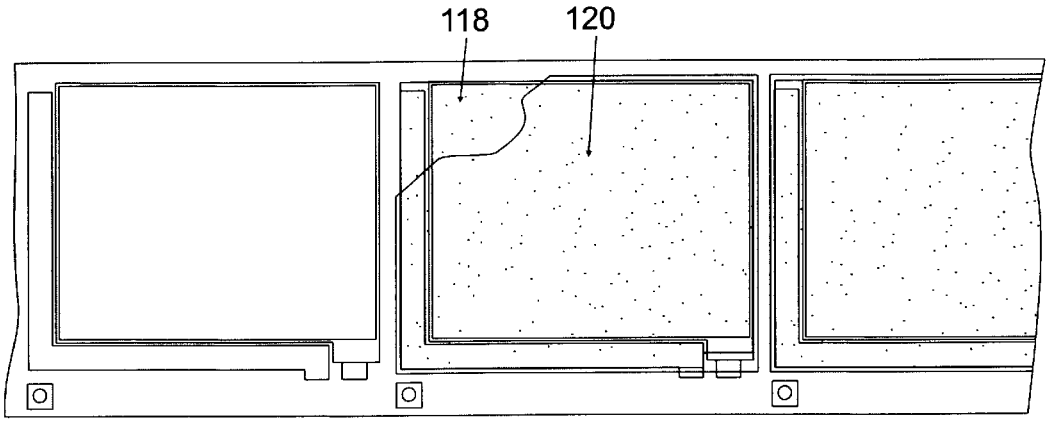

Referring to FIGS. 1(*a*)–(*e*), a sequence of top view diagrams illustrating a preferred method for manufacturing an EL lamp in accordance with the present invention is shown.

In the first step of the method, typically an approximately 0.001 inch thick metal foil is die cut or chemically etched to form one or more rear capacitive electrodes 104 that precisely define the area of illumination, a front capacitive electrode power distribution bus 106, electrical power contacts 108 and 110, and an optical registration fiducial indicia 112, which are all permanently bonded to a plastic film or paper core stock 102. Alternatively, the metal foil can be embossed onto plastic film or paper core stock 102 from a separate metal foil supply. Alternatively, the optical registration fiducial indicia 112 may be printed in opaque or reflective ink upon the surface of core stock 102. The typical thickness of core stock 102 is approximately 0.005 inch if a plastic film is used and approximately 0.010 inch if a paper stock is used. The die cutting or chemical etching can be performed by any of numerous conventional means. Additionally, the plastic film or paper core stock 102 may be coupled to a conventional optically registered flat stock indexing feed mechanism (not shown) to facilitate automated production.

In the next step, a layer of hygrophobically compounded capacitive dielectric ink 114 is applied over rear electrodes 104. The capacitive dielectric ink 114 is allowed to bleed approximately 0.020 inch beyond the edges of the rear electrodes 104, and up to the inside edge of power distribution bus 106, thereby insulating rear capacitive electrodes 104. Additionally, the dielectric ink may also extend well beyond the rear electrode pattern so as to provide a positive aesthetic appearance to the final EL lamp assembly. Additionally, the dielectric ink may be dyed or imbued with pigmentation to provide for illuminated and non-illuminated color effects.

In the next step, a layer of hygrophobically compounded EL phosphor ink 116 is applied over the capacitive dielectric ink layer 114 to provide precisely defined illumination. To provide precise illuminated area definition, the EL phosphor ink is allowed to bleed over the rear electrodes 104 to a point approximately one half that of the dielectric layer bleed. A layer of light transmissive, hygrophobically compounded and electrically conductive ink layer 118 is then applied, covering the entire EL phosphor ink layer 116. The electrically conductive ink layer 118 is allowed to bleed beyond the capacitive dielectric layer 114 that covers the rear capacitive electrodes 104, and over the power distribution bus 106 to create the front capacitive plate element and a means to address electrical power to the same. The use of an optically registered flat stock indexing feed mechanism allows the distribution of capacitive dielectric ink, El phosphor ink and electrically conductive ink to be specifically limited to those areas of rear capacitive electrodes 104 which are to be illuminated. For example, complex graphical patterns such as circles within circles, text, or individually addressable lamp elements (pixels) may be created.

In an alternative step, the electrically conductive ink layer 118 may be augmented or replaced by a conductive metal oxide layer such as indium tin oxide (ITO).

Continuing with FIGS. 1(*a*)–(*e*), a transparent or translucent polyester film is applied over the entire lamp surface to provide light transmissive electrical and environmental encapsulation 120. Typical application of environmental encapsulation 120 leaves electrical power contacts 108 and 110 exposed. Ordinarily, polyester film 120 is approximately 0.0005–0.010 in thickness, depending upon the level of isolation desired for specific applications. Thicker polyester films may be used for architectural application such as abrasion resistant illuminated floor elements. An alternative to polyester film environmental encapsulation 120 is polycarbonate, or any other plastic film or sheet suitable for specific applications, such as illuminated rigid wall panels. An alternative construction also allows use of screen-printable, or flood-coated, ultraviolet activated light transparent encapsulating inks as environmental encapsulation 120.

In an alternative first step, the metal foil may be replaced by a metal plated surface that is formed into the rear capacitive electrodes 104, front capacitive electrode bus 106, power distribution and electrical connection circuitry 108 and 110, and finally the optical registration fiducial indicia 112. In another alternative first step, an electrically conductive plastic film that has been die cut or chemically modified to create the above referenced electrical and indexing elements may replace the metal foil. In addition, a plastic dielectric film imbued with EL phosphors may replace the EL phosphor ink layer 116. Similarly, the conductive ink 118 may be replaced or augmented by a plating of ITO or other metal/metal oxide light transmissive, electrically conductive layer applied over the EL phosphor layer 116.

Plastic or paper core stock 102 may be replaced any variety of flexible non-conducting materials such as a thin fiberglass reinforced plastic. Further, plastic or paper core stock 102 may be replaced by a metal foil that has been coated on one or both surfaces by layers of capacitive dielectric insulation; EL phosphor ink; an electrically conductive, light transmissive layer; and finally, by a light transmissive insulating coating or encapsulation.

Figure 2:
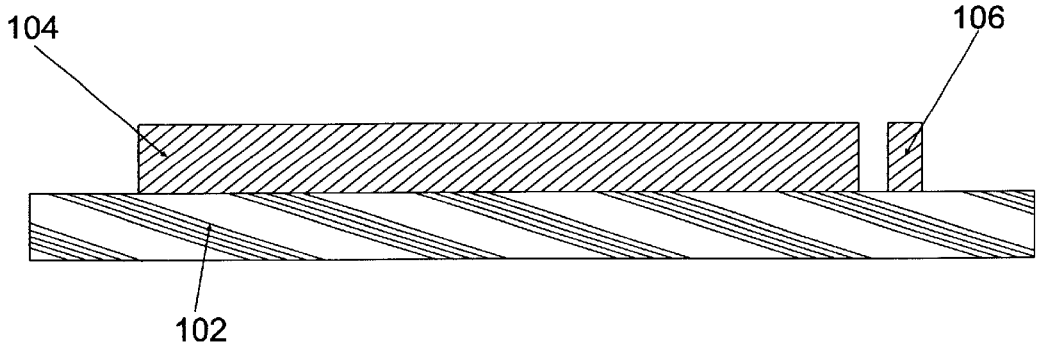
FIGS. 2(*a*)–(*e*) are a sequence of cross-sectional views of the manufacturing sequence of a first exemplary EL lamp 100 constructed in accordance with the method of FIGS. 1(*a*)–(*e*)
Figure 2:
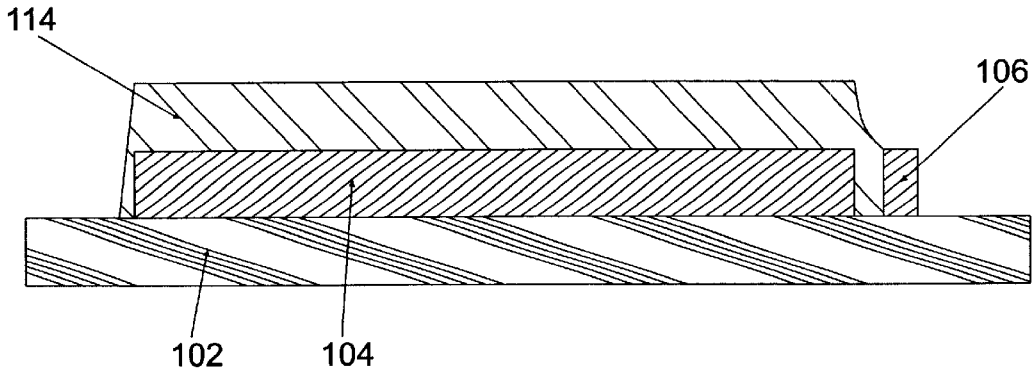
Figure 2:
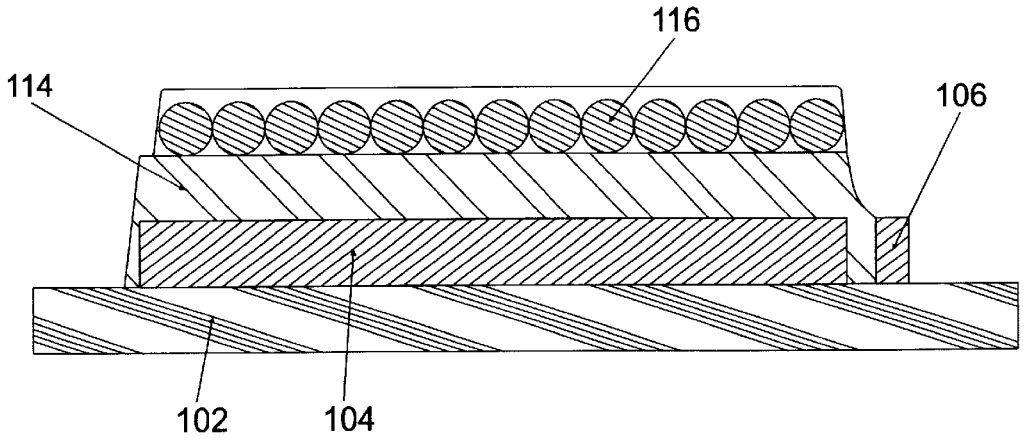
Figure 2:
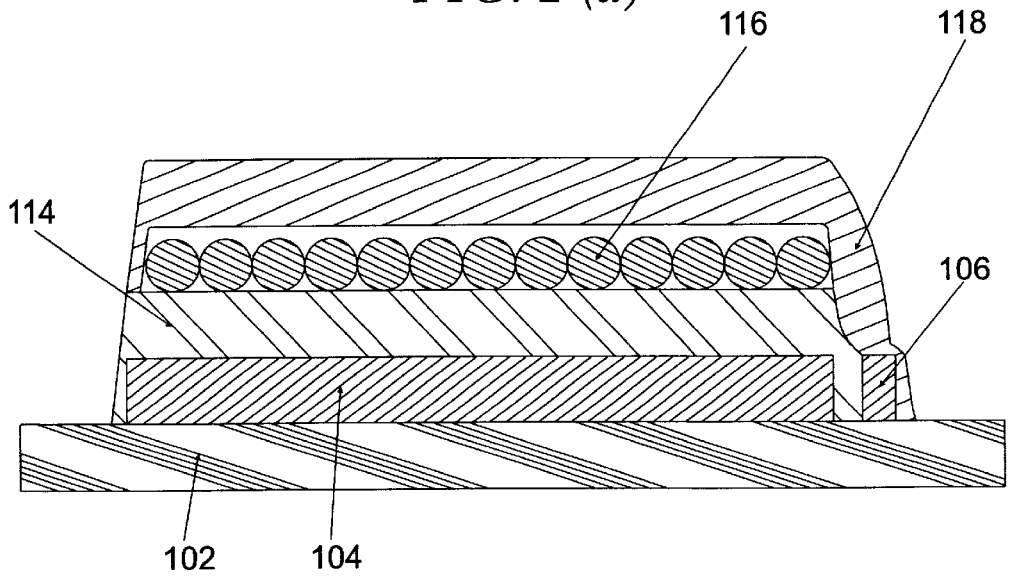
Figure 2:
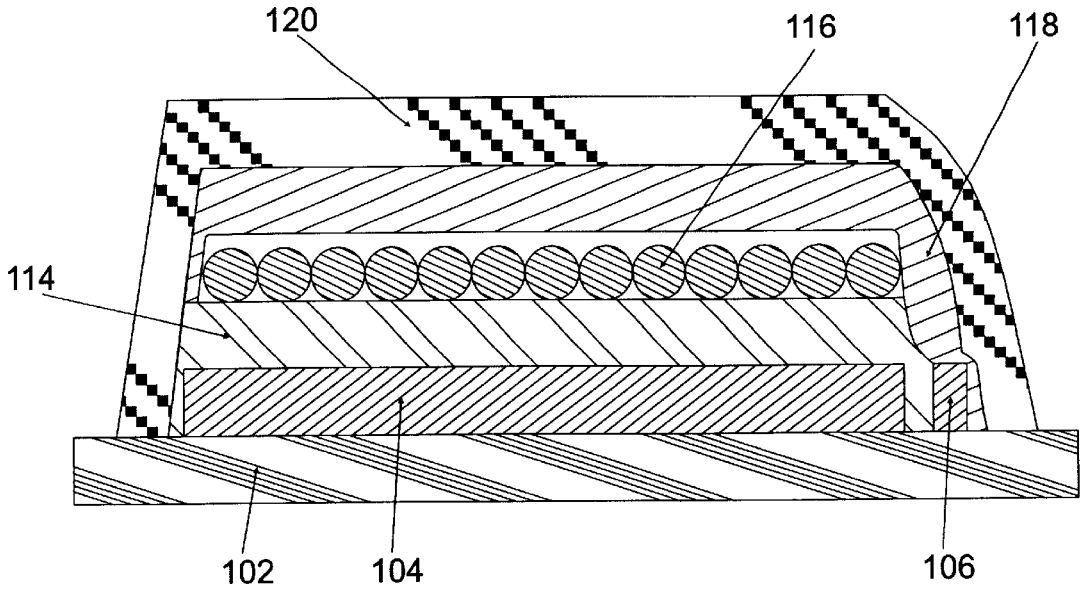

Referring now to FIGS. 2(*a*)–(*e*), a cross-sectional view of the construction of a first exemplary EL lamp 100, constructed in accordance with the above method is shown. Lamp 100 includes plastic or paper core stock 102; capacitive electrode layer 104; front capacitive electrode power distribution bus 106; capacitive dielectric insulation layer 114; EL phosphor layer 116; light transmissive electrically conductive layer 118; and light transmissive polyester film environmental encapsulation 120. Note that capacitive dielectric insulation layer 114 is allowed to fill the gap between the rear capacitive electrode 104 and the front capacitive electrode power distribution bus 106.

Also note that while EL phosphor layer 116 is allowed to bleed beyond the edges of rear capacitive electrode 104, it is not allowed contact with the front capacitive electrode power distribution bus 106, and in conjunction with layer 114, provides electrical isolation between layers 104 and 118. Additionally, light transmissive electrically conductive layer 118 contacts the front capacitive electrode power distribution bus 106 making electrical connection between 118 and 106.

Finally, the light transmissive polyester film environmental encapsulation 120 bleeds beyond all previous layers and extends onto plastic or paper core stock 102, providing both electrical safety isolation and an environmental attack resistant encapsulating envelope.

Figure 3:
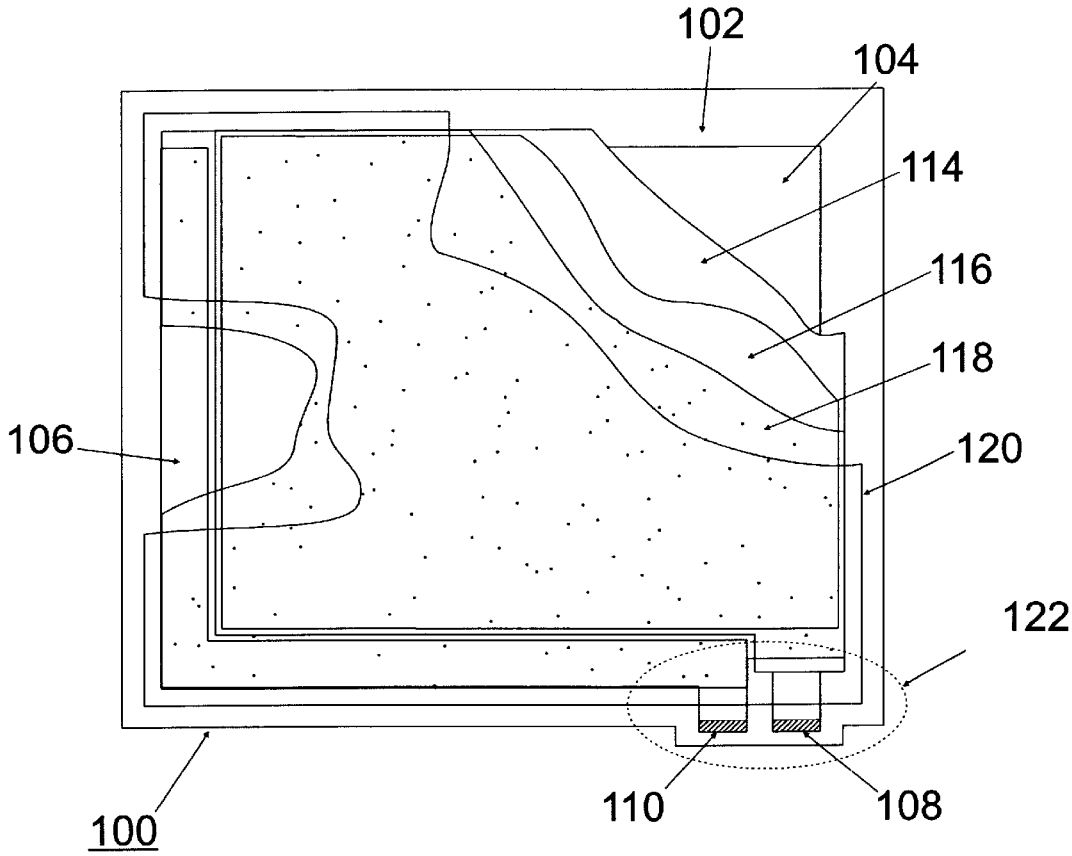
FIG. 3 is a top view of EL lamp 100 of FIGS. 2(*a*)–(*e*)

FIG. 3 provides a top view of first exemplary EL lamp 100. As shown in FIG. 3, the rear capacitive electrode 104 and the EL phosphor layer 116 define a rectangular area of illumination. However, the specific shape of the area of illumination is not limited to simple rectangles, circles and polygons. Any pattern with which the rear capacitive electrode 104 may be made and any pattern that may be printed in EL phosphor ink may also define the area of illumination.

Continuing with FIG. 3, metal foil conductors 108 and 110 are used to provide electrical power to rear capacitive electrode 104 and front conductive layer 118. Circled area 122 defines the electrical connection and interface of EL lamp 100. In this example, electrical connection and interface area 122 are shown as minimal protrusion exposed electrical connections 108 and 110.

Alternatively, 122 may form an extended pattern that creates a convenient electrical connection ribbon wire for more remote electrical interface to the applied power source. When suitable alternating (AC) or pulsed direct current (DC) power is applied to metal foil conductors 108 and 110, current flows between the capacitive plates, energizing the EL phosphor layer 116 thus providing illumination. Note also that the mechanical structure of EL lamp 100 provides a lighting source that may be both lightweight and flexible.

Figure 4:
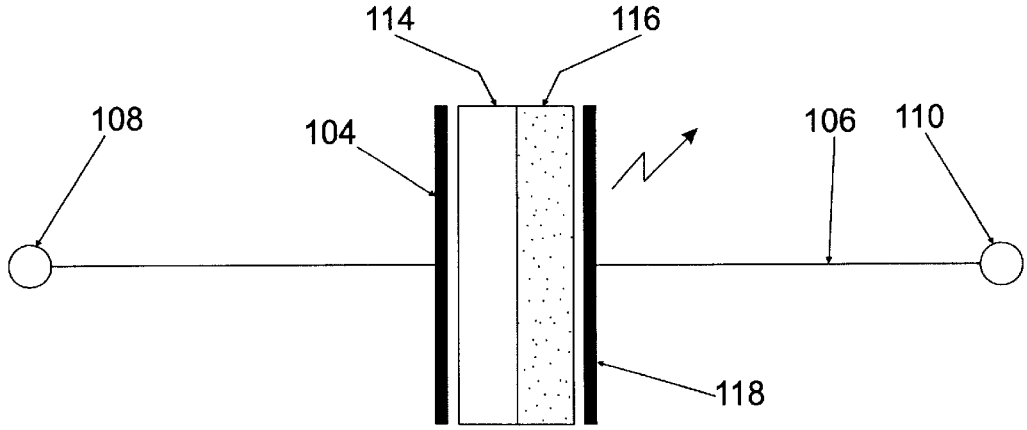
FIG. 4 is a schematic diagram of an equivalent circuit of EL lamp 100.

Referring now to FIG. 4, a schematic diagram of an equivalent electrical circuit of EL lamp 100 is shown. EL lamp 100 acts as an electrical capacitor, wherein rear electrode 104 is one capacitive plate, and front conductive surface 118 forms a second, light transmissive capacitive plate. Capacitive dielectric layer 114 and EL phosphor layer 116 forms the dielectric of the capacitor. When suitable alternating (AC) or pulsed direct current (DC) power is applied to metal foil conductors 108 and 110, current flows between the capacitive plates, current passes through EL phosphor layer 116 resulting in illumination.

Figure 5:
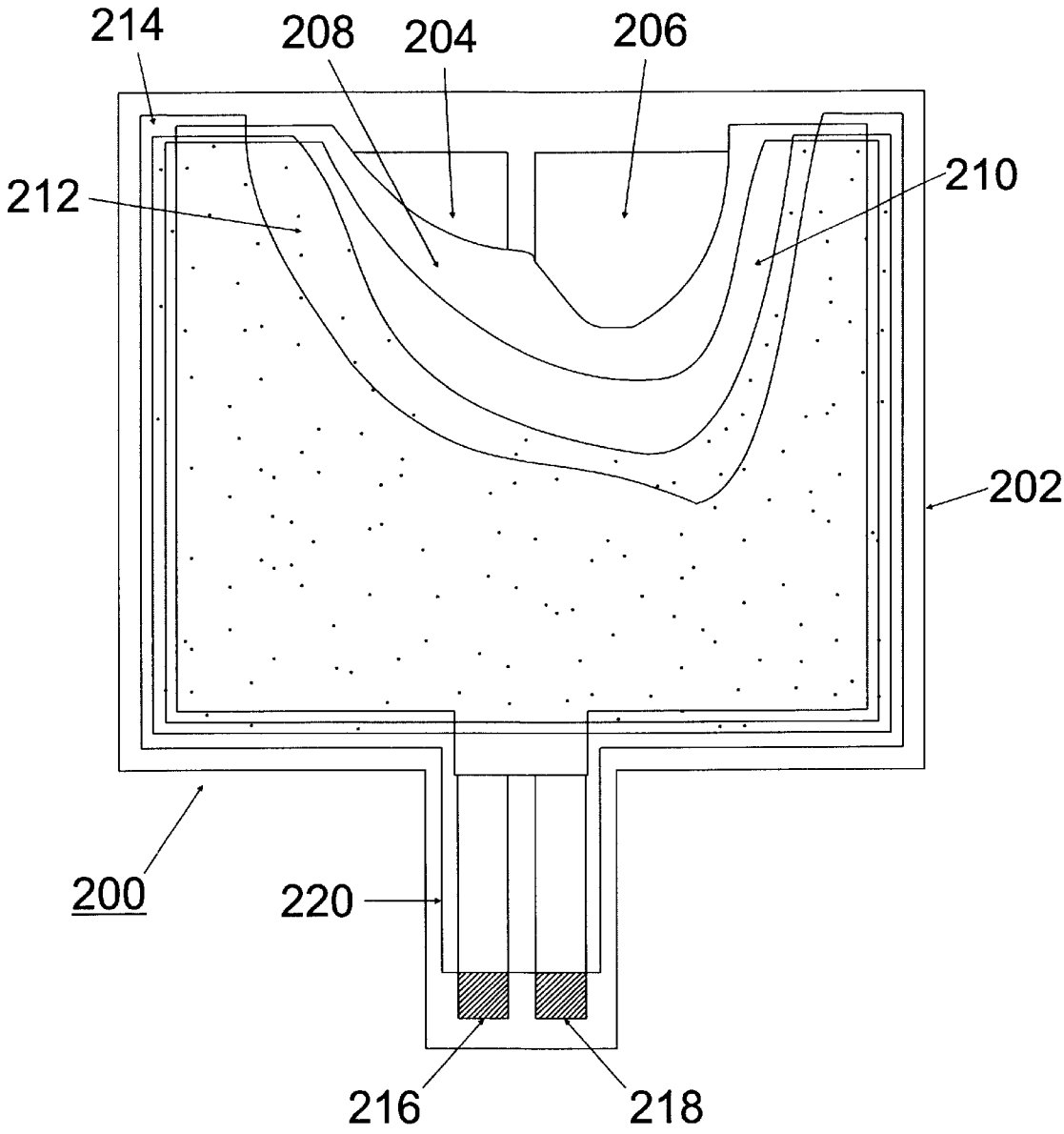
FIG. 5 is a top view of a second exemplary EL lamp 200.

Referring now to FIG. 5, a top view of a second exemplary EL lamp 200. Multiple rear electrodes 204 and 206 are formed upon plastic or paper core stock 202. Capacitive dielectric 208 and EL phosphor 210 layers are formed such as to bleed beyond rear electrodes 204 and 206, with layer 208 further isolating EL phosphor layer 210 from rear electrodes 204 and 206. Further, capacitive dielectric layer 208 extends over electrical power conductors 216 and 218 thus providing additional electrical isolation of layer 210. Light transmissive, electrically conductive layer 212 is applied over layers 208 and 210 forming a front capacitive electrode. Light transmissive polyester film environmental encapsulation 214 covers all previous layers and extends onto plastic or paper core stock 102, and extending onto electrical power conductors 216 and 218, providing both electrical safety isolation and an environmental attack resistant encapsulating envelope.

Electrical power conductors 216 and 218 are shown here as extended tabs from rear electrodes 204 and 206, combining with core stock 202 and insulating layer 214 to create a convenient electrical connection flat ribbon wire 220 for remote electrical interface with the applied power source. The shape of electrical interface 220 is shown as a simple rectangular tab. Electrical interface 220 may also comprise any shape or size appropriate to facilitate remote electrical connection. Electrical power conductors 216 and 218 may be exposed and configured to form accessible electrical power input contacts.

Continuing in reference to FIG. 5, rear electrodes 204 and 206, and EL phosphor layer 210 define a pair of rectangular areas of illumination. However, the specific shape of the area of illumination is not limited to simple rectangles, circles and polygons. Any pattern with which the rear capacitive electrode 204 and 206 may be made, and any pattern that may be printed in EL phosphor ink may also define the area of illumination. Additionally, the number of rear electrodes so defined is not limited to two, as any number of electrodes of any shape may also be patterned for illumination. When an appropriate alternating (AC) or pulsed direct current (DC) power is applied to metal foil conductors 216 and 218, current flows between the rear capacitive plates 204 and 206 via the path of front electrode 212. Electrical current passes from rear electrodes 204 and 206 through EL phosphor layer 210 to front electrode 212 resulting in illumination.

Figure 6:
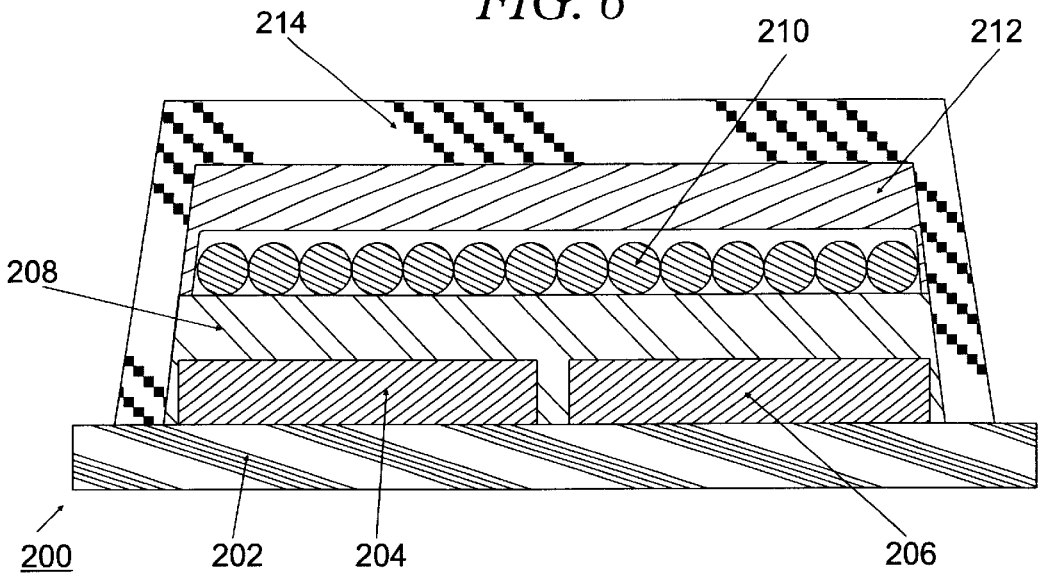
FIG. 6 is a cross-sectional view of EL lamp 200 of FIG. 5.

Now, in reference to FIG. 6, a cross-sectional view of completed second exemplary lamp 200. Rear capacitive electrodes 204 and 206 are permanently bonded to plastic or paper core stock 202. Capacitive dielectric layer 208 and El phosphor layer 210 completely cover rear electrodes 204 and 206, while light transmissive electrically conductive layer 212 extends beyond EL phosphor layer 210, creating a front sympathetic capacitive plate. The light transmissive polyester film environmental encapsulation layer 214 extends beyond layers 208, 210 and 212 respectively, and onto core stock 202 providing both electrical safety isolation and an environmental attack resistant encapsulating envelope. Note also that the mechanical structure of EL lamp 200 provides a lighting source that is both lightweight and flexible.

Figure 7:
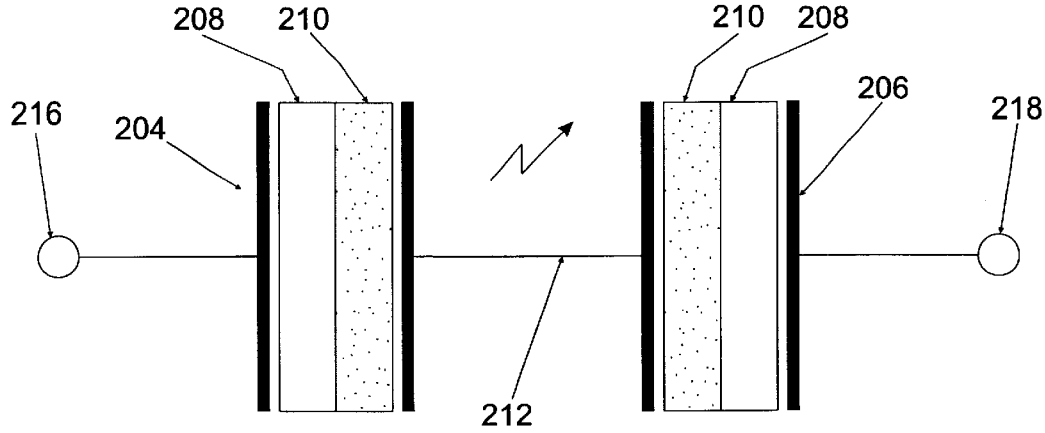
FIG. 7 is a schematic diagram of an equivalent circuit of EL lamp 200.

Referring now to FIG. 7, a schematic diagram of an equivalent electrical circuit of EL lamp 200 is shown. EL lamp 200 acts as an electrical capacitor, wherein rear electrodes 204 and 206 are two capacitive plates, and front conductive surface 212 forms a third, interfacial sympathetic capacitive plate. Capacitive dielectric layer 208 and EL phosphor layer 210 form the dielectric of the capacitor. When suitable alternating (AC) or pulsed direct current (DC) power is applied to metal foil conductors 216 and 218, current flows between the three capacitive plates, with current passing through EL phosphor layer 210 that results in illumination.

Figure 8:
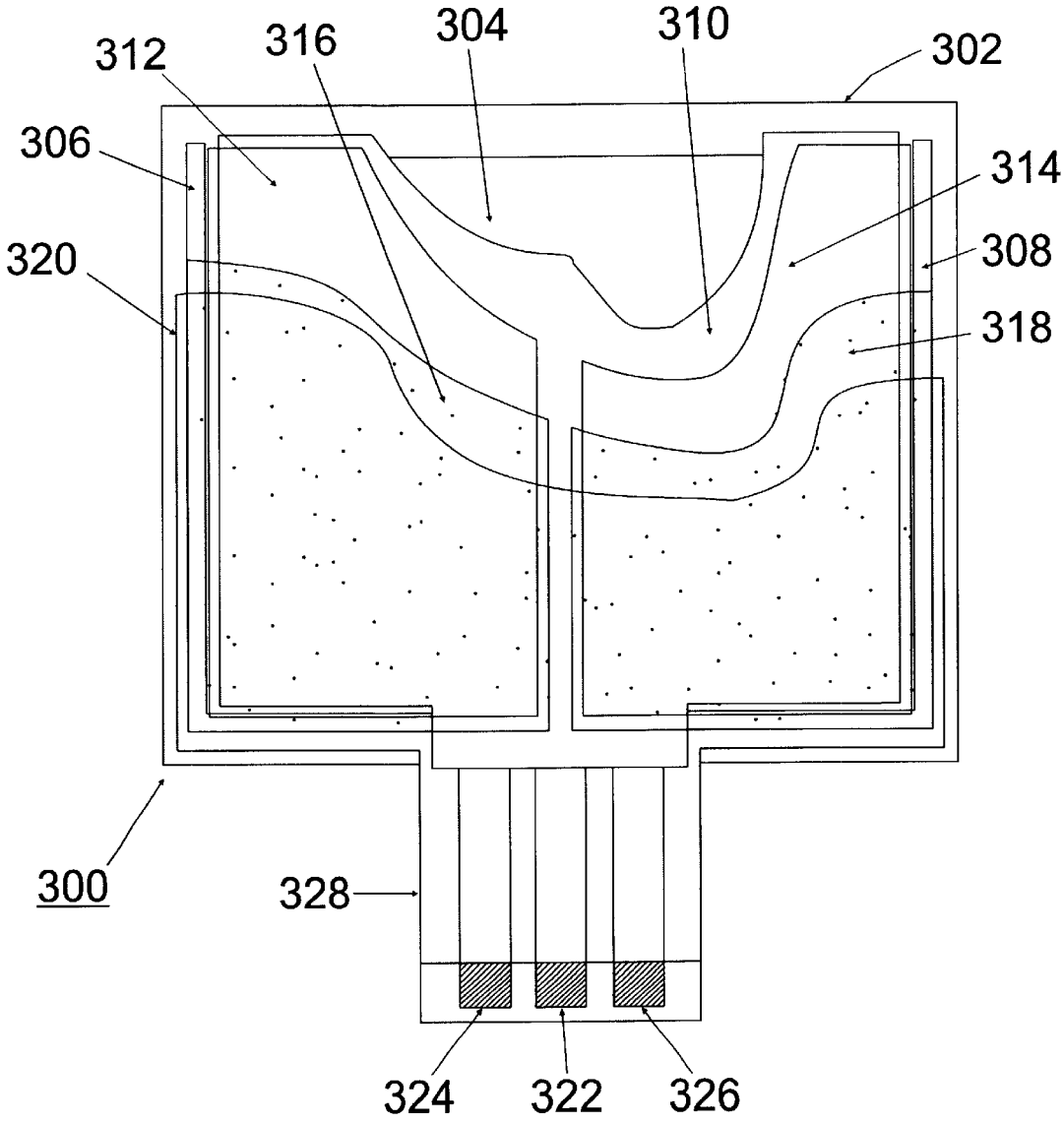
FIG. 8 is a top view of a third exemplary EL lamp 340.

FIG. 8 is a top view of a third exemplary EL lamp 340 made in accordance with the present inventive method. Rear electrode 344 is formed upon plastic or paper core stock 342. Capacitive front electrode power distribution buses 346 and 348 interface with front capacitive electrodes 316 and 318 to provide input power via electrical power connections 324 and 326. Capacitive dielectric layer 310 and EL phosphor layers 312 and 314 are formed such as to bleed beyond rear electrode 344, with layer 310 further isolating EL phosphor layers 312 and 314 from rear electrode 344. Further, capacitive dielectric layer 310 extends over electrical power conductors 322, 324 and 326 thus providing additional electrical isolation. Light transmissive, electrically conductive layers 316 and 318 are applied over EL phosphor layers 312 and 314 forming front addressable front capacitive electrodes. Light transmissive polyester film environmental encapsulation 320 covers all previous layers and extends onto plastic or paper core stock 342, and also extends onto electrical power conductors 322, 324 and 326, providing both electrical safety isolation and an environmental attack resistant encapsulating envelope. Electrical power conductors 322, 324 and 326 are shown here as extended tabs from rear electrode 344 and front electrode power buses 346 and 348, combining with core stock 342 and insulating layer 320, creating a convenient electrical connection flat ribbon wire 328 for remote electrical interface with the applied power source. The shape of electrical interface 328 is shown as a simple rectangular tab. Electrical interface 328 may also comprise any shape or size appropriate to facilitate remote electrical connection. Electrical power conductors 322, 324 and 326 may be exposed and configured to form accessible electrical connection input contacts.

Continuing in reference to FIG. 8, EL phosphor layers 312 and 314, and front conductive layers 316 and 318 define a pair of rectangular areas of illumination that use rear electrode 344 as their common capacitive plate. However, the specific shape of the area of illumination is not limited to simple rectangles, circles and polygons. Any pattern with which the rear capacitive electrode 344, EL phosphor layers 312 and 314, and front conductive layers 316 and 318 may be made, may also define the area of illumination. Additionally, the number of front electrodes so defined is not limited to two, as any number of electrodes of any shape may also be patterned for illumination. When an appropriate alternating (AC) or pulsed direct current (DC) power is applied to metal foil rear electrode conductor 322 and front electrode conductor 324, current flows between the rear capacitive plate 344 and front electrode 316. An electrical current passing from rear electrode 344, through EL phosphor layer 312, to front electrode 316 results in an area specific illumination. Additionally, by applying power to metal foil rear electrode conductor 322 and front electrode conductor 326, current flows from rear electrode 344 through EL phosphor layer 314 to front electrode 318, resulting in area specific illumination. Further, applying appropriate alternating (AC) or pulsed direct current (DC) power to metal foil conductors 324 and 326 causes electrical current to flow through EL phosphor layers 312 and 314 via the common rear capacitive electrode 344, thus illuminating both EL phosphor areas. By varying the selection of terminations used for input power, animation and brightness variations may be achieved within the same EL lamp.

Figure 9:
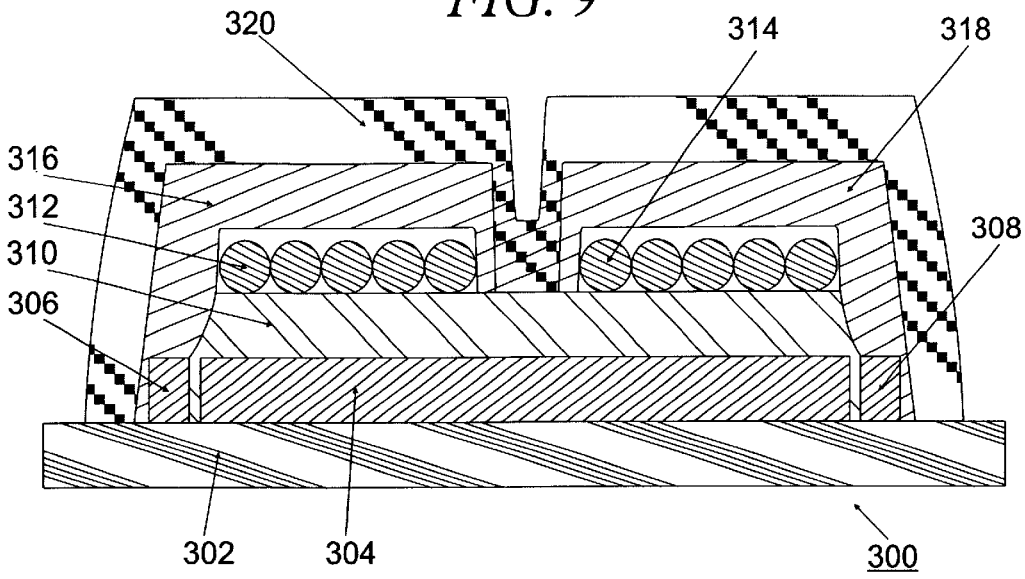
FIG. 9 is a cross-sectional view of EL lamp 340 of FIG. 8.

FIG. 9 illustrates a cross-sectional view of an exemplary EL lamp 340 as shown in FIG. 8. Rear capacitive electrode 344, and front capacitive electrode power distribution busses 346 and 348 are permanently bonded to plastic or paper core stock 342. Capacitive dielectric layer 310 is applied over rear electrode 344 and allowed to fill the open spaces between rear electrode 344 and front electrode power distribution buses 346 and 348, thus providing electrical isolation for EL phosphor layers 312 and 314.

Electrically conductive, light transmissive ink is printed to form front capacitive electrodes 316 and 318, with print bleed allowing front capacitive electrode 316 to contact front capacitive power distribution bus 346, and front capacitive electrode 318 to contact front capacitive power distribution bus 348 forming isolated electrical interfaces. Finally, light transmissive polyester film environmental encapsulation 320 covers all previous layers and extends onto plastic or paper core stock 342, providing both electrical safety isolation and an environmental attack resistant encapsulating envelope. Note also that the mechanical structure of EL lamp 340 provides a lighting source that is both lightweight and flexible.

Figure 10:
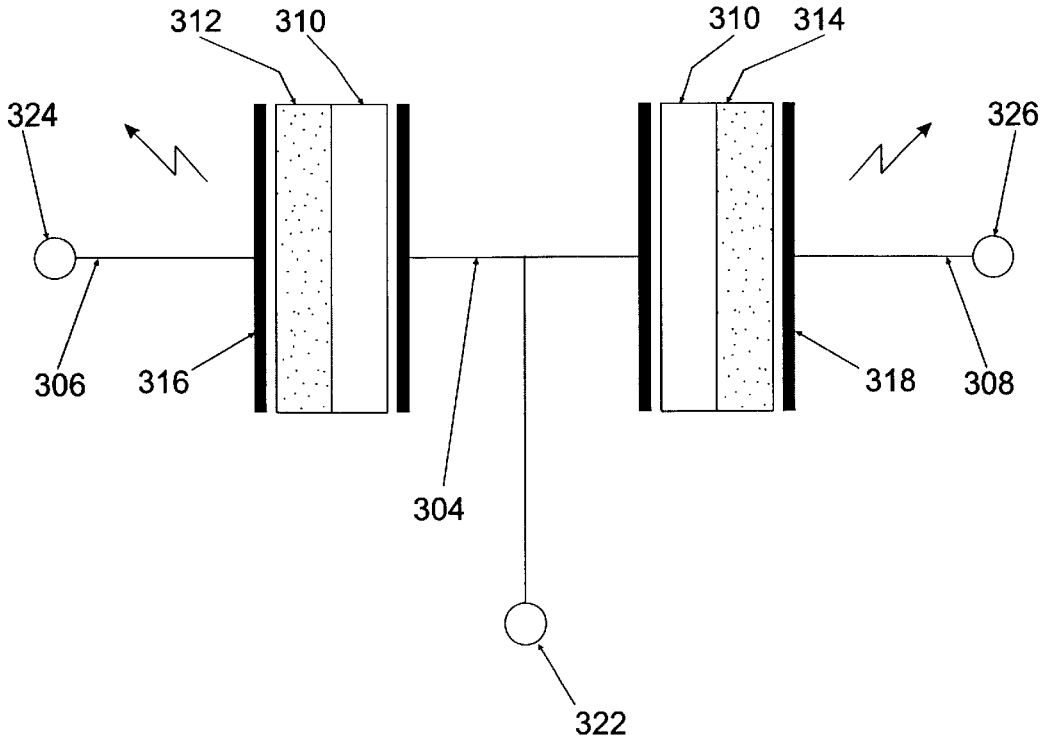
FIG. 10 is a schematic diagram of an equivalent circuit of EL lamp 340.

Continuing now with FIG. 10, a schematic diagram of an equivalent electrical circuit of EL lamp 340 is shown. EL lamp 340 acts as an electrical capacitor, wherein rear electrode 344 and independently addressable front conductive surfaces 316 and 318 form two capacitors in series with a common rear electrode connection between them. Capacitive dielectric layer 310 and EL phosphor layers 312 and 314 form the dielectric of their respective capacitors. When an appropriate alternating (AC) or pulsed direct current (DC) power is applied to metal foil rear electrode 344 and light transmissive front electrode 316, current flows through EL phosphor layer 312 resulting in an area specific illumination. Additionally, by applying power to metal foil rear electrode 344 and light transmissive front electrode 318, current flows through EL phosphor layer 314 resulting in area specific illumination. Further, applying appropriate alternating (AC) or pulsed direct current (DC) power to light transmissive front electrodes 316 and 318 causes an electrical current to flow through EL phosphor layers 312 and 314 via the common rear capacitive electrode 344, thus illuminating both EL phosphor areas. By varying the selection of capacitive plates used for input power, animation and brightness variations may be achieved within the same EL lamp.

Thus, the method of the present invention provides an automated means to manufacture high volumes of electroluminescent lamps at minimal labor cost, and minimal constituent raw material wastage. Additionally, EL lamps produced by the method of the present invention consume low power, and generate little waste heat. Further, the EL lamps produced by the method of the present invention are significantly more robust than those of conventional manufacture, and may be connected to power sources and other controlling electrical circuitry via processes typically reserved for ordinary flexible printed circuit board products.

The forgoing description includes what are at present considered to be preferred embodiments of the invention. However, it will be readily apparent to those skilled in the art that various changes and modifications may be made to the embodiments without departing from the spirit and scope of the invention. Accordingly, it is intended that such changes and modifications fall within the scope of the invention, and that the invention be limited only by the following claims.

What is claimed is:

1. A method for manufacturing an electroluminescent lamp, said method comprising the following steps of:

forming a capacitive electrode from a metal foil by embossing said metal foil onto an insulating flexible plastic film;

forming electrical distribution pathways connected to said capacitive electrode from a metal foil by embossing said metal foil onto said insulating flexible plastic film;

forming electrical terminations that connect to said electrical distribution pathways from a metal foil by embossing said metal foil onto said insulating flexible plastic film;

forming a positioning optical registration indicia from a metal foil by embossing said metal foil onto said insulating flexible plastic film;

applying said insulating flexible plastic film to an optically registered indexing system, said optically registered indexing system to use said optical registration indicia to precisely position said insulating flexible plastic film for further electroluminescent lamp construction processing;

applying a layer of capacitive dielectric to said metal foil capacitive electrode, said capacitive dielectric for electrically isolating said capacitive electrode;

applying a layer of electroluminescent phosphor to said capacitive dielectric layer, said electroluminescent phosphor layer precisely defines an area of illumination;

applying a light transmissive electrically conductive layer to said layer of electroluminescent phosphor, said light transmissive electrically conductive layer having a surface; and applying a light transmissive insulating coating to the surface of said light transmissive electrically conductive layer.

2. The method of claim 1 wherein said metal foil is die cut to form said capacitive electrode.

3. The method of claim 1 wherein said metal foil is chemically etched to form said capacitive electrode.

4. The method of claim 1 wherein said metal foil is laser cut to form said capacitive electrode.

5. The method of claim 1 wherein said capacitive electrode is formed from a layer of electrically conductive ink.

6. The method of claim 1 wherein said capacitive electrode is formed from a layer of deposited metal.

7. The method of claim 1 wherein said metal foil is die cut to form said electrical distribution pathways.

8. The method of claim 1 wherein said metal foil is chemically etched to form said electrical distribution pathways.

9. The method of claim 1 wherein said metal foil is laser cut to form said electrical distribution pathways.

10. The method of claim 1 wherein said electrical distribution pathways is formed from a layer of electrically conductive ink.

11. The method of claim 1 wherein said electrical distribution pathways is formed from a layer of deposited metal.

12. The method of claim 1 wherein said metal foil is die cut to form said electrical terminations.

13. The method of claim 1 wherein said metal foil is chemically etched to form said electrical terminations.

14. The method of claim 1 wherein said metal foil is laser cut to form said electrical terminations.

15. The method of claim 1 wherein said electrical terminations is formed from a layer of electrically conductive ink.

16. The method of claim 1 wherein said electrical terminations is formed from a layer of deposited metal.

17. The method of claim 1 wherein said metal foil is die cut to form said positioning optical registration indicia.

18. The method of claim 1 wherein said metal foil is chemically etched to form said positioning optical registration indicia.

19. The method of claim 1 wherein said metal foil is laser cut to form said positioning optical registration indicia.

20. The method of claim 1 wherein said positioning optical registration indicia is an opaque ink layer.

21. The method of claim 1 wherein said positioning optical registration indicia is a reflective ink layer.

22. The method of claim 1 wherein said positioning optical registration indicia is a layer of deposited metal.

23. The method of claim 1 wherein said capacitive dielectric layer is a plastic film.

24. The method of claim 1 wherein said capacitive dielectric layer is an ink.

25. The method of claim 1 wherein said capacitive dielectric layer is applied via plasma spray.

26. The method of claim 1 wherein said electroluminescent phosphor layer is an electroluminescent phosphor particle imbued plastic film.

27. The method of claim 1 wherein said electroluminescent phosphor layer is an electroluminescent phosphor particle imbued ink.

28. The method of claim 1 wherein said electroluminescent phosphor layer is applied via plasma spray.

29. The method of claim 1 wherein said light transmissive electrically conductive layer is a conductive metal oxide coated plastic film.

30. The method of claim 1 wherein said light transmissive electrically conductive layer is a conductive ink containing metal oxide.

31. The method of claim 1 wherein said light transmissive electrically conductive layer is a sputter coated layer containing metal oxide.

32. The method of claim 1 wherein said light transmissive electrically conductive layer is a plasma spray coated metal oxide.

33. The method of claim 1 wherein said light transmissive electrically conductive layer is a conductive organic polymer comprised of PEDOT (Poly-3,4-Ethyelenedioxithiophene).

34. A method for manufacturing an electroluminescent lamp, said method comprising the following steps of:

forming a capacitive electrode from a metal foil by embossing said metal foil onto an insulating paper core stock;

forming electrical distribution pathways connected to said capacitive electrode from a metal foil by embossing said metal foil onto said insulating paper core stock;

forming electrical terminations that connect to said electrical distribution pathways from a metal foil by embossing said metal foil onto said insulating paper core stock;

forming a positioning optical registration indicia from a metal foil by embossing said metal foil onto said insulating paper core stock;

applying said insulating paper core stock to an optically registered indexing system, said optically registered indexing system to use said optical registration indicia to precisely position said insulating paper core stock for further electroluminescent lamp construction processing;

applying a layer of capacitive dielectric to said metal foil capacitive electrode, said capacitive dielectric for electrically isolating said capacitive electrode;

applying a layer of electroluminescent phosphor to said capacitive dielectric layer, said electroluminescent phosphor layer for precisely defining an area of illumination;

applying a light transmissive electrically conductive layer to said layer of electroluminescent phosphor; and applying a light transmissive insulating coating to a surface of said light transmissive electrically conductive layer.

35. The method of claim 34 wherein said metal foil is die cut to form said capacitive electrode.

36. The method of claim 34 wherein said metal foil is chemically etched to form said capacitive electrode.

37. The method of claim 34 wherein said metal foil is laser cut to form said capacitive electrode.

38. The method of claim 34 wherein said capacitive electrode is a layer of electrically conductive ink.

39. The method of claim 34 wherein said capacitive electrode is a layer of deposited metal.

40. The method of claim 34 wherein said metal foil is die cut to form said electrical distribution pathways.

41. The method of claim 34 wherein said metal foil is chemically etched to form said electrical distribution pathways.

42. The method of claim 34 wherein said metal foil is laser cut to form said electrical distribution pathways.

43. The method of claim 34 wherein said electrical distribution pathways is a layer of electrically conductive ink.

44. The method of claim 34 wherein said electrical distribution pathways is a layer of deposited metal.

45. The method of claim 34 wherein said metal foil is die cut to form said electrical terminations.

46. The method of claim 34 wherein said metal foil is chemically etched to form said electrical terminations.

47. The method of claim 34 wherein said metal foil is laser cut to form said electrical terminations.

48. The method of claim 34 wherein said electrical terminations is a layer of deposited metal.

49. The method of claim 34 wherein said metal foil is die cut to form said positioning optical registration indicia.

50. The method of claim 34 wherein said metal foil is chemically etched to form said positioning optical registration indicia.

51. The method of claim 34 wherein said metal foil is laser cut to form said positioning optical registration indicia.

52. The method of claim 34 wherein said positioning optical registration indicia is an opaque ink layer.

53. The method of claim 34 wherein said positioning optical registration indicia is a reflective ink layer.

54. The method of claim 34 wherein said optical registration indicia pathways is a layer of deposited metal.

55. The method of claim 34 wherein said capacitive dielectric layer is a plastic film.

56. The method of claim 34 wherein said capacitive dielectric layer is an ink.

57. The method of claim 34 wherein said capacitive dielectric layer is applied via plasma spray.

58. The method of claim 34 wherein said electroluminescent phosphor layer is an electroluminescent phosphor imbued plastic film.

59. The method of claim 34 wherein said electroluminescent phosphor layer is an electroluminescent phosphor imbued ink.

60. The method of claim 34 wherein said electroluminescent phosphor layer is applied via plasma spray.

61. The method of claim 34 wherein said light transmissive electrically conductive layer is a conductive metal oxide coated plastic film.

62. The method of claim 34 wherein said light transmissive electrically conductive layer is a conductive ink containing metal oxide.

63. The method of claim 34 wherein said light transmissive electrically conductive layer is a sputter coated metal oxide.

64. The method of claim 34 wherein said light transmissive electrically conductive layer is a plasma spray coated metal oxide.

65. The method of claim 34 wherein said light transmissive electrically conductive layer is a conductive organic polymer comprised of PEDOT (Poly-3,4-Ethyelenedioxithiophene).

* * * * *